US008688014B2

(12) United States Patent
Shigehiro

(10) Patent No.: US 8,688,014 B2
(45) Date of Patent: Apr. 1, 2014

(54) IMAGE FORMING APPARATUS

(75) Inventor: Koji Shigehiro, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 198 days.

(21) Appl. No.: 13/403,243

(22) Filed: Feb. 23, 2012

(65) Prior Publication Data

US 2012/0230707 A1 Sep. 13, 2012

(30) Foreign Application Priority Data

Mar. 7, 2011 (JP) ..... 2011-049224

(51) Int. Cl.
*G03G 15/08* (2006.01)

(52) U.S. Cl.
USPC ..... 399/258; 399/53

(58) Field of Classification Search
USPC ..... 399/258, 53
See application file for complete search history.

(56) References Cited

U.S. PATENT DOCUMENTS

| | | | | |
|---|---|---|---|---|
| 7,680,422 | B2 * | 3/2010 | Nakaue et al. | 399/44 |
| 7,773,890 | B2 * | 8/2010 | Chiba et al. | 399/27 |
| 2007/0177904 | A1 * | 8/2007 | Arai | 399/262 |
| 2009/0317105 | A1 * | 12/2009 | Tsutsumi et al. | 399/53 |
| 2012/0134690 | A1 * | 5/2012 | Tanaka | 399/44 |
| 2013/0183049 | A1 * | 7/2013 | Tanaka | 399/27 |

FOREIGN PATENT DOCUMENTS

| | | | |
|---|---|---|---|
| JP | 9-134066 | A | 5/1997 |
| JP | 11-249408 | A | 9/1999 |
| JP | 2006-65317 | A | 3/2006 |
| JP | 2007-232992 | A | 9/2007 |
| JP | 2080-275998 | A | 11/2008 |

* cited by examiner

*Primary Examiner* — G. M. Hyder
(74) *Attorney, Agent, or Firm* — Fitzpatrick, Cella, Harper & Scinto

(57) ABSTRACT

A temperature sensor detects information regarding humidity in an atmosphere of a developing container. A temperature sensor detects information regarding humidity in an atmosphere of a toner hopper. An inductance sensor detects information regarding a toner density within the developing container. A printer controller controls a replenishing operation of a replenishing screw member based on image information. The printer controller controls the replenishing operation of the replenishing screw member so that a toner density within the developing container is less than or equal to a predetermined value based on a detection result of the inductance sensor. The printer controller controls the predetermined value to be small when a difference between humidity detection results detected by each of the temperature sensors is large as compared to when the difference is small.

6 Claims, 14 Drawing Sheets

| RH DIVISION | 0≦⊿RH <20 | 20≦⊿RH <40 | 40≦⊿RH <60 | 60≦⊿RH <100 |
|---|---|---|---|---|
| CORRECTION AMOUNT | −0.5% | −1.0% | −1.5% | −2.0% |

| RH DIVISION | 5≦⊿RH<20 | 20≦⊿RH<40 | 40≦⊿RH |
|---|---|---|---|
| MAXI MUM REPLENISHMENT AMOUNT | 3 ROTATIONS | 2 ROTATIONS | 1 ROTATION |

| RH DIVISION | 0≦⊿RH <5 | 5≦⊿RH <20 | 20≦⊿RH <40 | 40≦⊿RH <60 | 60≦⊿RH |
|---|---|---|---|---|---|
| PULLBACK POTENTIAL DIFFERENCE | 170V | 150V | 140V | 130V | 120V |

*FIG. 14*

| SLEEVE GHOST LEVEL | DENSITY DIFFERENCE |
|---|---|
| 10 | 0 ~ 0.01 |
| 9 | ~ 0.02 |
| 8 | ~ 0.03 |
| 7 | ~ 0.04 |
| 6 | ~ 0.05 |
| 5 | ~ 0.06 |
| 4 | ~ 0.07 |
| 3 | ~ 0.08 |
| 2 | ~ 0.09 |
| 1 | 0.089 ~ |

IMAGE FORMING APPARATUS

BACKGROUND OF THE INVENTION

1. Field of the Invention

The present invention relates to an image forming apparatus such as a printer or a copy machine, and more particularly, to an image forming apparatus of an electrophotographic system using a dry-type two-component developing method.

2. Description of the Related Art

In an image forming apparatus using an electrophotographic system according to the related art, a surface of a photosensitive drum 1 serving as an electrostatic latent image bearing member is uniformly charged by a charging roller 2 as illustrated in FIGS. 1 and 2. The charged photosensitive drum 1 is exposed by an exposure apparatus 3 according to image information, and an electrostatic latent image is formed on the photosensitive drum 1.

For the electrostatic latent image formed on the photosensitive drum 1, a toner image is visualized by toner of a developer using a developing device 4. A transfer device 5 transfers the visualized toner image onto a recording material 10. Thereafter, a fixing device 6 fuses and fixes the toner image transferred onto the recording material 10 by applying heat and pressure to the recording material 10. A cleaning device 7 removes toner remaining on the photosensitive drum 1 after the above-described transfer process to prepare for the next image forming process.

A two-component developer having non-magnetic toner particles (hereinafter referred to as "toner") and magnetic carrier particles (hereinafter referred to as "magnetic carriers") is used as a developer for the developing device 4. In particular, a color image forming apparatus 100 is widely used because of, for example, good color tone since a magnetic material may not be included in the toner.

There is an issue in that a sleeve ghost phenomenon occurs when the toner within the developing device 4 is consumed by image formation and an image is formed by toner replenishment for the consumed toner. Here, the sleeve ghost is a phenomenon in which a shape of a toner image formed in a first rotation of a developing sleeve 44 during image formation appears in a second rotation of the developing sleeve 44.

In the related art, the sleeve ghost is generated when a ratio of toner particles having small particle diameters to those having an average particle diameter of the toner is high. The toner particles having the small particle diameters may be attracted by a pullback potential difference due to a potential difference between a white background potential on the photosensitive drum 1 and a surface potential of the developing sleeve 44. It is difficult to separate the toner particles from the surface of the developing sleeve 44 because an adhesion force is large due to a reflection force for the small particle diameters.

Thus, an amount of toner in the second rotation is increased by an amount of toner not supplied for development of the first rotation and directly attached to the surface of the developing sleeve 44. Thereby, a charging amount of toner with the small particle diameter is decreased by newly supplied toner and easily subjected to development in which the reflection force is small, so that chargeability for a latent image potential on the photosensitive drum 1 of the second rotation is improved and a toner density is increased to appear as an image defect.

On the other hand, Japanese Patent Laid-Open No. 2006-065317 discusses technology for defining a percentage by number of particles of which a volume-average particle diameter of toner is less than or equal to 4 μm because the sleeve ghost is easily generated if a proportion of particles of which the volume-average particle diameter of toner is less than or equal to 4 μm exceeds 8 percent by number.

However, as another factor in which the sleeve ghost is generated, a toner amount around a charging amount "0" is increased and a charging amount distribution of toner within a developing container 41 becomes broad. As a factor in which the charging amount distribution of toner becomes broad, a difference may occur between a charging amount of toner within the developing container 41 and a charging amount of replenishment toner. For example, a developer within the developing container 41 during image formation in a high-temperature, high-humidity environment has a smaller charging amount than the developer in a normal-temperature, normal-humidity environment. For example, when a toner bottle filled with the toner is used in the normal-temperature, normal-humidity environment, the charging amount of the replenishment toner in the beginning of supply is larger than that of original toner within the developing container 41.

Thus, once a magnetic carrier is in contact with replenishment toner, an electrostatic adhesion force is high and therefore the magnetic carrier is still in contact with the replenishment toner. Because the original toner within the developing container 41 in which the charging amount is small has a small electrostatic adhesion force with the magnetic carrier, it does not easily adhere to the magnetic carrier covered with the replenishment toner. Thereby, when the developer is supplied to the developing sleeve 44, toner having a small charging amount not attached to the magnetic carrier is attached to the surface of the developing sleeve 44 by a pullback potential difference. This toner serves as under toner. Here, the under toner refers to a toner layer formed on the developing sleeve 44 and attached onto the surface of the developing sleeve 44 to which a magnetic brush formed by the developer is not attached.

In addition, conversely, when an image forming apparatus is provided in a low-humidity environment, relative humidity of replenishment toner is higher than that within the developing container 41. Thus, when original toner within the developing container 41 covers the magnetic carrier, there is little opportunity for the replenishment toner to make contact with the magnetic carrier. In particular, an increase in the under toner due to toner having the low-charging amount for which an opportunity to make contact with the magnetic carrier is small easily occurs when a toner coverage rate of the magnetic carrier is high and a T/D ratio is high. Here, the T/D ratio is a mixture ratio between the non-magnetic toner and the magnetic carrier within the developing container 41, and refers to a ratio of non-magnetic toner weight (T) to total weight (D) of the magnetic carrier and the non-magnetic toner.

Thereby, the toner is developed on a latent image part drawn by laser in a toner image formed in the first rotation of the developing sleeve 44, and an amount of generation of the above-described under toner is small. In addition, toner is in a state in which the force is applied in a surface direction of the developing sleeve 44 all the way during image formation due to a pullback potential difference in a non-image formation part, not the latent image part. Thus, the under toner is easily generated, and the low charged toner or the uncharged toner serves as the under toner and is adsorbed onto the surface of the developing sleeve 44 because the reflection force with the magnetic carrier is weak. Thereby, an amount of toner to be supplied in a developing process in the second rotation of the developing sleeve 44 is biased at a latent image position by the under toner generated in the first rotation, and a sleeve ghost image is generated.

The present invention provides an image forming apparatus capable of reducing a sleeve ghost caused by a charging amount difference between a developer and replenishment toner within a developing device when temperature/humidity of a replenishing container is different from that within the developing container.

SUMMARY OF THE INVENTION

The present invention provides an image forming apparatus including a developing container in which toner and a magnetic carrier are accommodated, a replenishing container in which replenishment toner is accommodated, a replenishing device which replenishes a developer within the replenishing container into the developing container, a first humidity detection portion which detects information regarding humidity in an atmosphere of the developing container, a second humidity detection portion which detects information regarding humidity in an atmosphere of the replenishing container, a density sensor which detects information regarding a toner density within the developing container, a first controller which controls a replenishing operation of the replenishing device so that the toner density within the developing container is less than or equal to a predetermined value based on a detection result of the density sensor, and a second controller which controls the predetermined value to be small when a difference between humidity detection results detected by each of the first and second humidity detection portions is large as compared to when the difference is small.

Further features of the present invention will become apparent from the following description of exemplary embodiments with reference to the attached drawings.

BRIEF DESCRIPTION OF THE DRAWINGS

FIG. 14 is a diagram illustrating an example in which a sleeve ghost level in an evaluation image was evaluated in 10 steps according to a density difference between a ghost generation portion and a halftone portion around the ghost generation portion.

DESCRIPTION OF THE EMBODIMENTS

Hereinafter, an image forming apparatus according to the present invention will be described in detail with reference to the drawings.

First Embodiment

Entire Configuration and Operation of Image Forming Apparatus

Figure 1:
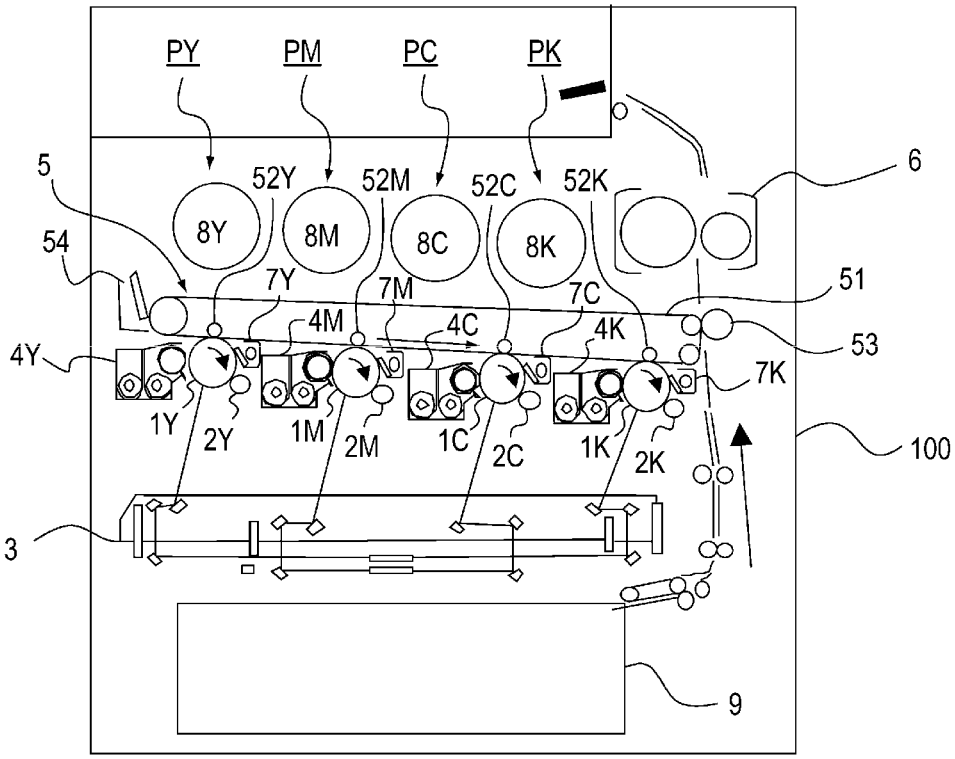
FIG. 1 is a schematic sectional view illustrating an entire configuration of an image forming apparatus according to the present invention.
Figure 2:
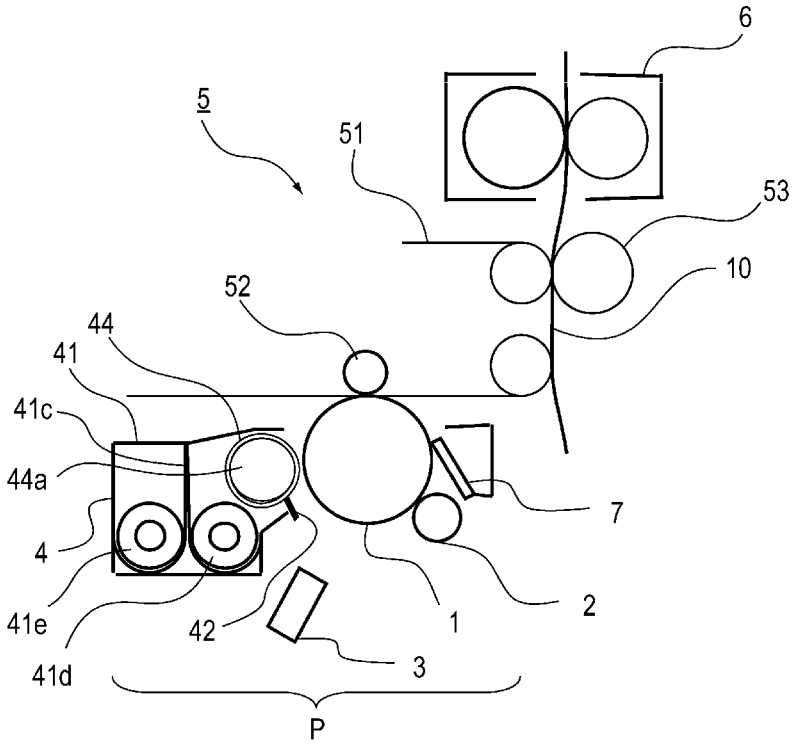
FIG. 2 is a schematic sectional view illustrating an image forming station of the image forming apparatus according to the present invention.

First, the entire configuration and the operation of the image forming apparatus of this embodiment will be described. FIG. 1 is an entire schematic diagram of an image forming apparatus of an electrophotographic system. FIG. 2 illustrates a schematic configuration of an image forming station. An image forming apparatus 100 of this embodiment forms an image on a recording material 10 according to image information from one of a document reading apparatus connected to a main body of the image forming apparatus 100 and a host device such as a personal computer communicably connected to the main body of the image forming apparatus 100. For example, a full-color image of four colors of yellow (Y), magenta (M), cyan (C), and black (K) is formed on the recording material 10 such as a recording sheet, a plastic sheet, or a cloth using the electrophotographic system.

The image forming apparatus 100 of this embodiment uses a four continuous tandem system, and has first, second, third, and fourth image forming portions PY, PM, PC, and PK, which form Y, M, C, and K images, as a plurality of image forming portions. While an intermediate transfer belt 51 serving as an intermediate transfer body (ITB) provided in a transfer device 5 moves in an arrow direction of FIG. 1 and passes through the image forming portions PY to PK, color images in the image forming portions PY to PK may be superimposed on the intermediate transfer belt 51. A recording image may be obtained by transferring a multiplex toner image superimposed on the intermediate transfer belt 51 to the recording material 10.

In the following embodiment, configurations of the image forming portions PY, PM, PC, and PK are substantially the same, except that developing colors are different. Hereinafter, if a particular distinction is unnecessary, a suffix Y, M, C, or K indicating an element belonging to any of the image forming portions PY to PK is omitted. The image forming portions PY, PM, PC, and PK are collectively referred to as the image forming portion P.

The image forming portion P has a photosensitive drum 1 including a drum-like photosensitive body as an electrostatic latent image bearing member, which bears an electrostatic latent image according to image information. A charging roller 2 serving as a charging device, an exposure device 3 including a laser-exposing optical system, a developing device 4, a transfer device 5, and a cleaning device 7 are provided at an outer periphery of the photosensitive drum 1. A toner cartridge 8 is provided. The transfer device 5 has the intermediate transfer belt 51 as an ITB. The intermediate transfer belt 51 turns over a plurality of rollers and rotates in an arrow direction of FIG. 1. In addition, a primary transfer member 52 is disposed at a position facing each photosensitive drum 1 via the intermediate transfer belt 51. In addition, a secondary transfer member 53 is provided at a position facing one of the rollers over which the intermediate transfer belt 51 turns.

When an image is formed, first, the charging roller 2 uniformly charges a surface of the rotating photosensitive drum 1. Then, the exposure device 3 scans and exposes the surface of the charged photosensitive drum 1 according to an image information signal, thereby forming an electrostatic latent image on the photosensitive drum 1. The electrostatic latent image formed on the photosensitive drum 1 is visualized as a toner image by toner of a developer using the developing device 4.

A toner image formed on the photosensitive drum 1 is primarily transferred onto the intermediate transfer belt 51 by the action of a primary transfer bias voltage applied to the primary transfer member 52 in a primary transfer nip portion that the intermediate transfer belt 51 and the photosensitive drum 1 abut. For example, when a four-color-based full-color image is formed, a toner image is transferred from each photosensitive drum 1 onto the intermediate transfer belt 51 in order from the image formation portion PY, and a multiplex toner image in which a four-color toner image is superimposed is formed on the intermediate transfer belt 51.

On the other hand, a pickup roller, a conveying roller, and a registration roller convey the recording material 10 accommodated in a sheet cassette to a secondary transfer nip portion that the intermediate transfer belt 51 and the secondary transfer member 53 abut in synchronization with the toner image on the intermediate transfer belt 51. The multiplex toner image on the intermediate transfer belt 51 is transferred onto the recording material 10 by the action of a secondary transfer bias voltage applied to the secondary transfer member 53 in the secondary transfer nip portion.

Thereafter, the recording material 10 separated from the intermediate transfer belt 51 is conveyed to a fixing device 6. The fixing device 6 fuses and mixes the toner image transferred onto the recording material 10 by applying heat and pressure, and fixes the toner image onto the recording material 10. Thereafter, the recording material 10 is discharged outside the apparatus.

An attachment such as toner remaining on the photosensitive drum 1 after a primary transfer process is collected by the cleaning device 7. Thereby, the photosensitive drum 1 is prepared for the next image formation process. In addition, the attachment, such as toner remaining on the intermediate transfer belt 51 after the secondary transfer process, is removed by an ITB cleaner 54.

The image forming apparatus 100 of this embodiment can also form a single- or multi-color image, such as a single color black image, using an image forming portion for a desired single color or some of the four colors.

<Basic Configurations of Developing Device and Replenishing Container>

Next, the configuration of the developing device 4 will be further described with reference to FIGS. 3 and 4.

The developing device 4 has a developing container 41, which accommodates a two-component developer including non-magnetic toner and a magnetic carrier. In the developing container 41, a developing sleeve 44 and a magnet roll 44*a* are disposed to face the photosensitive drum 1. The developing sleeve 44 serves as a developer bearing member, which supplies toner to the photosensitive drum 1, and the magnet roll 44*a* includes a magnet as a magnetic field generation unit disposed to be fixed within the developing sleeve 44. A developing blade 42 is disposed to form a thin layer of the developer on a surface of the developing sleeve 44, and screw members 41*d* and 41*e* are disposed to agitate and convey the developer within the developing container 41.

A partition wall 41*c*, extending in a vertical direction, partitions an inner portion of the developing container 41 into a developing chamber 41*a* also serving as a developer conveyance path and an agitation chamber 41*b* also serving as the developer conveyance path. The screw member 41*d* is disposed in the developing chamber 41*a* and the screw member 41*e* is disposed in the agitation chamber 41*b*. Delivery portions 41*f* and 41*g* are provided on two ends (left and right sides of FIG. 3) in a longitudinal direction of the partition wall 41*c*. The delivery portions 41*f* and 41*g* also serve as developer conveyance paths, which allow the developer to pass between the developing chamber 41*a* and the agitation chamber 41*b*.

In this embodiment, the screw members 41*d* and 41*e* are each formed by providing spiral blades as conveying portions around magnetic-body shafts (rotary shafts). In addition, agitating ribs 41*e*1 are provided on the screw member 41*e* in addition to the spiral blades. The agitating ribs 41*e*1 are projected in a radial direction from the shaft and each have a predetermined width in a conveyance direction of the developer. The agitating ribs 41*e*1 agitate the developer according to shaft rotation.

The screw members 41*d* and 41*e* are disposed substantially in parallel along a rotary shaft direction of the developing sleeve 44. The screw members 41*d* and 41*e* convey the developer in reverse directions to each other along the rotary shaft direction of the developing sleeve 44. The screw members 41*d* and 41*e* circulate the developer within the developing container 41 via the delivery portions 41*f* and 41*g*. That is, the developer within the developing chamber 41*a* in which toner is consumed and a toner density is low in a developing process moves inside the agitation chamber 41*b* via one delivery portion 41*f* (the left side of FIG. 3) according to a conveyance force of the screw members 41*d* and 41*e*.

The screw members 41*d* and 41*e* circulate the developer within the developing container 41 by agitating and conveying the developer. As illustrated in FIG. 4, the developing sleeve 44 serving as a developer bearing member is rotatably disposed at a position facing the photosensitive drum 1 of the developing container 41. The magnet roll 44*a* serving as a magnetic field generation unit is embedded in the developing sleeve 44.

The two-component developer is in a state in which the toner is agitated and conveyed by the screw members 41*d* and 41*e* and adhered to a surface of a magnetic carrier by friction charging. The two-component developer is attracted to and borne on the surface of the developing sleeve 44 by a magnetic field generated by the magnet roll 44*a*.

The developer passes through the developer blade 42 by the rotation of the developing sleeve 44, and is coated on the developing sleeve 44 as a thin layer and conveyed to a portion facing the photosensitive drum 1. In the facing portion, the developer forms a chained magnetic brush due to the magnetic field generated by the magnet roll 44*a*. The magnetic brush is in the vicinity of or in contact with the photosensitive drum 1, only the toner is shifted to an electrostatic latent image formed on the surface of the photosensitive drum 1 according to a developing bias voltage applied to the developing sleeve 44, and a toner image corresponding to the electrostatic latent image is formed on the surface of the photosensitive drum 1.

The toner and the magnetic carrier of the two-component developer accommodated in the developing device 4 are agitated and charged by friction in the developing device 4 using the two-component developer to be used in the image forming apparatus 100 of the electrophotographic system as described above. Thereafter, the developing sleeve 44 supplies the developer to the photosensitive drum 1, thereby developing the electrostatic latent image on the photosensitive drum 1.

In addition, the toner consumed in the developing device 4 is replenished by a necessary amount from a toner hopper 84 or a toner bottle as a toner replenishing container in which replenishment toner is accommodated so that a T/D ratio, which is a ratio between the toner and the magnetic carrier of the two-component developer, is maintained.

The screw member 41*d* agitates and conveys the developer within the developing chamber 41*a*. In addition, the screw member 41*e* uniformizes the toner density for the purpose of auto toner replenisher (ATR) control. That is, the toner supplied from a toner replenishing portion 49 and the developer including the toner and the magnetic carrier already present within the agitation chamber 41*b* are agitated and conveyed, so that a toner density is uniformized.

In addition, a toner replenishing port adapted to replenish the toner to a farthest upstream portion of the agitation chamber 41*b* is provided and connected to the toner hopper 84 serving as a replenishing container in which replenishment toner illustrated in FIG. 7 is accommodated. In the replenishing port of the toner hopper 84, a replenishing screw member 85 is provided as a replenishing unit capable of conveying the developer (toner) within the toner hopper 84 to the developing container 41 in a fixed amount of toner. According to the above-described ATR control, the number of rotations is controlled according to a density detection result of a patch image according to an inductance sensor 45 and a patch image density detection sensor 11 as density sensors, which detect information regarding an image ratio when an image is formed and a toner density within the developer container 41.

The toner is replenished into the developer container 41. A printer controller 300 is also used as a first controller, which controls a replenishing operation of the replenishing screw member 85 serving as a replenishing unit based on image information. In addition, the printer controller 300 is also used as a second controller, which controls the replenishing operation of the replenishing screw member 85 serving as a replenishing unit so that the toner density within the developing container 41 is less than or equal to a predetermined value based on a detection result of the inductance sensor 45 serving as the density sensor.

Figure 3:
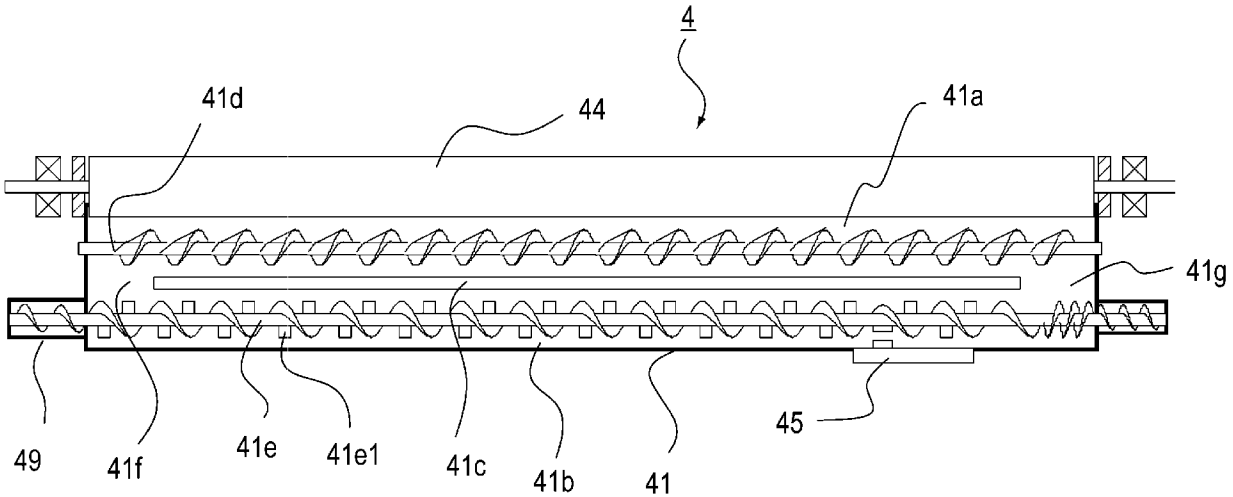
FIG. 3 is a schematic plan view illustrating a developing device of the image forming apparatus according to the present invention.
Figure 4:
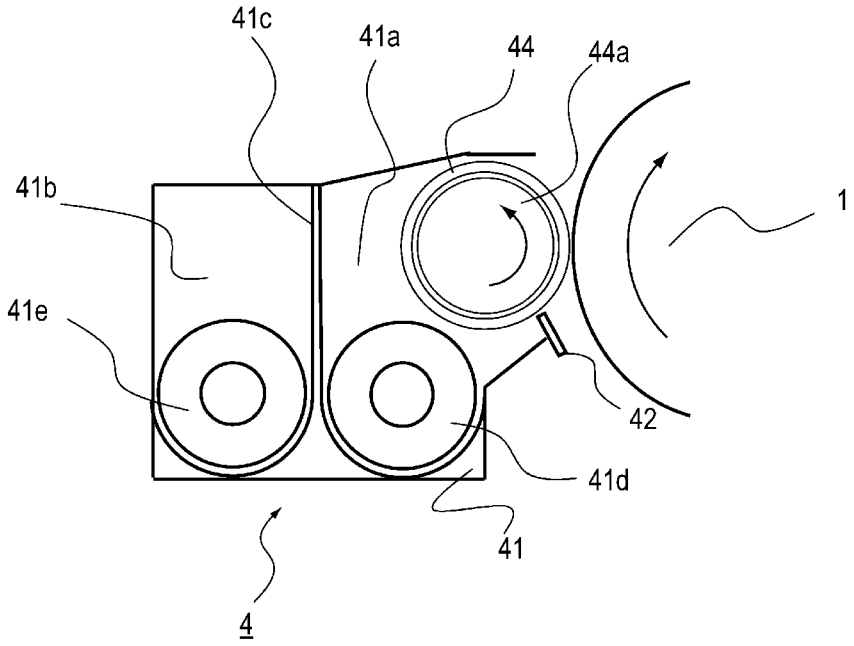
FIG. 4 is a schematic sectional view illustrating the developing device of the image forming apparatus according to the present invention.

A developer within the agitation chamber 41*b* in which the toner is replenished and agitated moves to the developing chamber 41*a* via the other delivery portion 41*g* (the right side of FIG. 3). In addition, the developing chamber 41*a* of the developing device 4 has an opening at a position corresponding to a developing area facing the photosensitive drum 1, and the developing sleeve 44 is rotatably disposed to be partially exposed in an opening portion 41*j* of the developing container 41. In this embodiment, the developing sleeve 44 is formed of a non-magnetic material and rotates in an arrow direction of FIG. 4 during a developing operation. As a magnetic field generation unit, the magnet roll 44*a* having a plurality of magnetic poles along a circumferential direction is fixed inside the developing sleeve 44.

The developer within the developing chamber 41*a* is supplied to the developing sleeve 44 by the screw member 41*d*. A predetermined amount of the developer supplied to the developing sleeve 44 is borne on the developing sleeve 44 according to a magnetic field generated by the magnet roll 44*a* to form a developer reservoir. When the developing sleeve 44 rotates, the two-component developer on the developing sleeve 44 passes through the developer reservoir and is conveyed to a developing area facing the photosensitive drum 1 while a layer thickness of the two-component developer is regulated by the developing blade 42. In the developing area, the developer on the developing sleeve 44 stands up as in a brush and forms a magnetic brush.

In this embodiment, the magnetic brush is in contact with the photosensitive drum 1, and the toner of the developer is supplied to the photosensitive drum 1, so that the electrostatic latent image on the photosensitive drum 1 is developed as a toner image. That is, the developing sleeve 44 serving as the developer bearing member is disposed to face the photosensitive drum 1 serving as an electrostatic latent image bearing member. The developing sleeve 44 supplies the toner to the photosensitive drum 1. In addition, a developing bias voltage obtained by superimposing a direct current (DC) voltage and an alternating current (AC) voltage is generally applied from a developing bias power source as a voltage application unit to the developing sleeve 44 in order to improve the developing efficiency, that is, a ratio at which the toner is assigned to the electrostatic latent image. After the toner has been supplied to the photosensitive drum 1, the developer on the developing sleeve 44 returns to the developing chamber 41*a* by rotation of the developing sleeve 44.

In the related art, an image forming apparatus having an image output capability of 50 ppm is used. In the ATR control, a T/D ratio of the developer provided for image formation is 9% in an initial state as a setting of a default of the T/D ratio. Here, the T/D ratio is a ratio of toner weight (T) to total weight (D) of the toner and the magnetic carrier. According to the number of image forming sheets, upper/lower limits of the T/D ratio are transitionally set in a range of ±3 [%] by maintaining a fixed charging amount.

The ATR control is performed by the above-described image ratio, the inductance sensor 45, and patch image detection. The inductance sensor 45 detects the T/D ratio according to a potential difference between an input voltage by a differential transformer and a voltage excited by carrier particles. A patch image is detected by measuring a reflection density of the patch image and predicting a charging amount of toner. First, a use amount of toner from an image signal input during image formation is calculated and set as a basic replenishment amount. The inductance sensor 45 determines a correction amount from a difference between a current T/D ratio and a target T/D ratio with respect to the above-described basic replenishment amount, and determines the toner replenishment amount.

In addition, a target value of the T/D ratio is changed so that an analog patch image is generated on one of the photosensitive drum 1 and an ITB of the intermediate transfer belt 51 every 100 sheets during an image forming job and the reflection density of the patch image is detected and fixed. Because the ATR control is basically used to constantly control the charging amount, the T/D ratio of the developer is transitioned so that the charging amount of the developer is fixed by patch image detection.

However, if the T/D ratio is too high or too low, an image defect occurs as will be described below. Accordingly, the upper/lower limit for control is set with respect to the T/D ratio (potential difference) detected by the above-described inductance sensor 45 so that the target value of the T/D ratio does not exceed a predetermined range. Specifically, even when a density change greater than or equal to a predetermined value has been detected by the patch image detection, a change amount of the target value of the inductance sensor 45 may be greater than or equal to the predetermined value. In this case, the target value of the T/D ratio detected by the inductance sensor 45 is controlled not to exceed the predetermined value by fixing the upper/lower limit of the inductance sensor 45.

In general, the upper limit of the T/D ratio set by the ATR control is determined by, for example, white background fog or an amount of toner scattering. The white background fog is an image defect, which appears on the recording material, such as the contamination of a white background due to toner developed in a white background portion (unexposed portion) not to be intrinsically printed. The lower limit of the T/D ratio is determined by screw trace or magnetic carrier attachment. In addition, the charging amount is uniformly controlled primarily in the above-described ATR control. Then, a developing contrast potential determined by a developing bias voltage, a charging bias voltage, and an exposure intensity of laser light is adjusted and an image density of an output image is adjusted.

For example, when an image is formed at a low image ratio, the toner of the developer is gradually charged up. Thus, the target value of the T/D ratio of the inductance sensor 45 is increased by initial patch image detection according to the above-described ATR control, so that control is performed to decrease a charging amount of toner and increase an image density. When an image is formed at a high image ratio, the process is executed in reverse.

Figure 5:
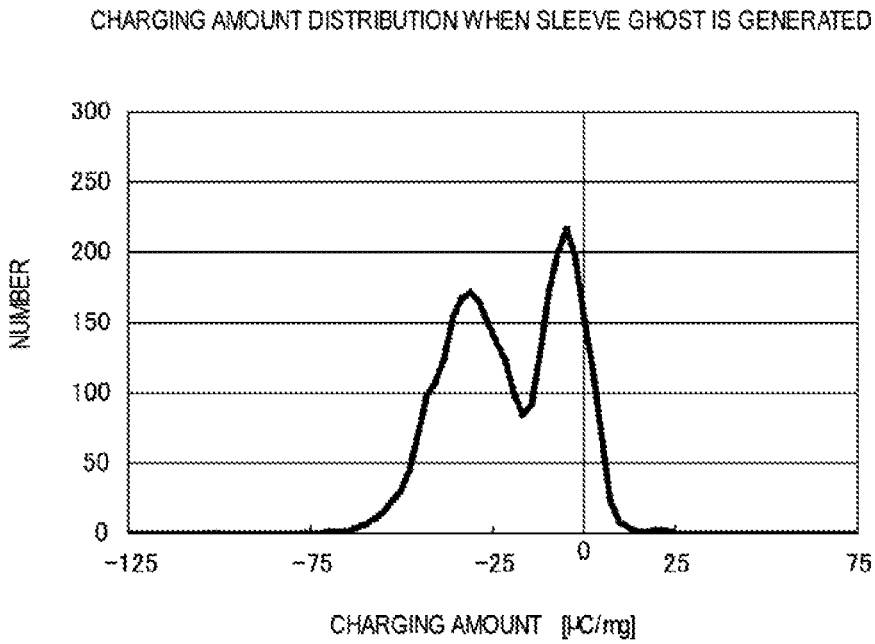
FIG. 5 PRIOR ART
FIG. 5 is an example of a charging amount distribution diagram when a sleeve ghost is generated in an example of the related art.

In a high-temperature, high-humidity environment or a low-humidity environment in which a difference between relative humidity (RH) of the developer within the developing container 41 and RH of replenishment toner within the toner hopper 84 easily occurs, the toner bottle within the toner hopper 84 may be exchanged when the developer is charged up in the above-described default setting. For example, when the inside of the developing container 41 is under the low humidity environment as compared to the toner hopper 84, the charging amount of toner already present within the developing container 41 is large and an uncharged toner amount to be replenished is large. Thus, a contact opportunity between the replenishment toner and the magnetic carrier is reduced, so that insufficiently charged toner is generated. A sleeve ghost is generated because a charging amount distribution of the developer becomes broad due to a large toner amount around a charging amount "0" as illustrated in FIG. 5.

In this embodiment, the temperature/humidity within the developing container 41 is compared to that within the toner hopper 84. According to the comparison result, a control range of the T/D ratio between the toner and the magnetic carrier within the developing container 41 is set when the toner bottle within the toner cartridge 8 communicating with the toner hopper 84 is exchanged. Hereinafter, an example in which the upper limit of the T/D ratio is set will be described.

<Configurations of Humidity Detection Portions>

Figure 6:
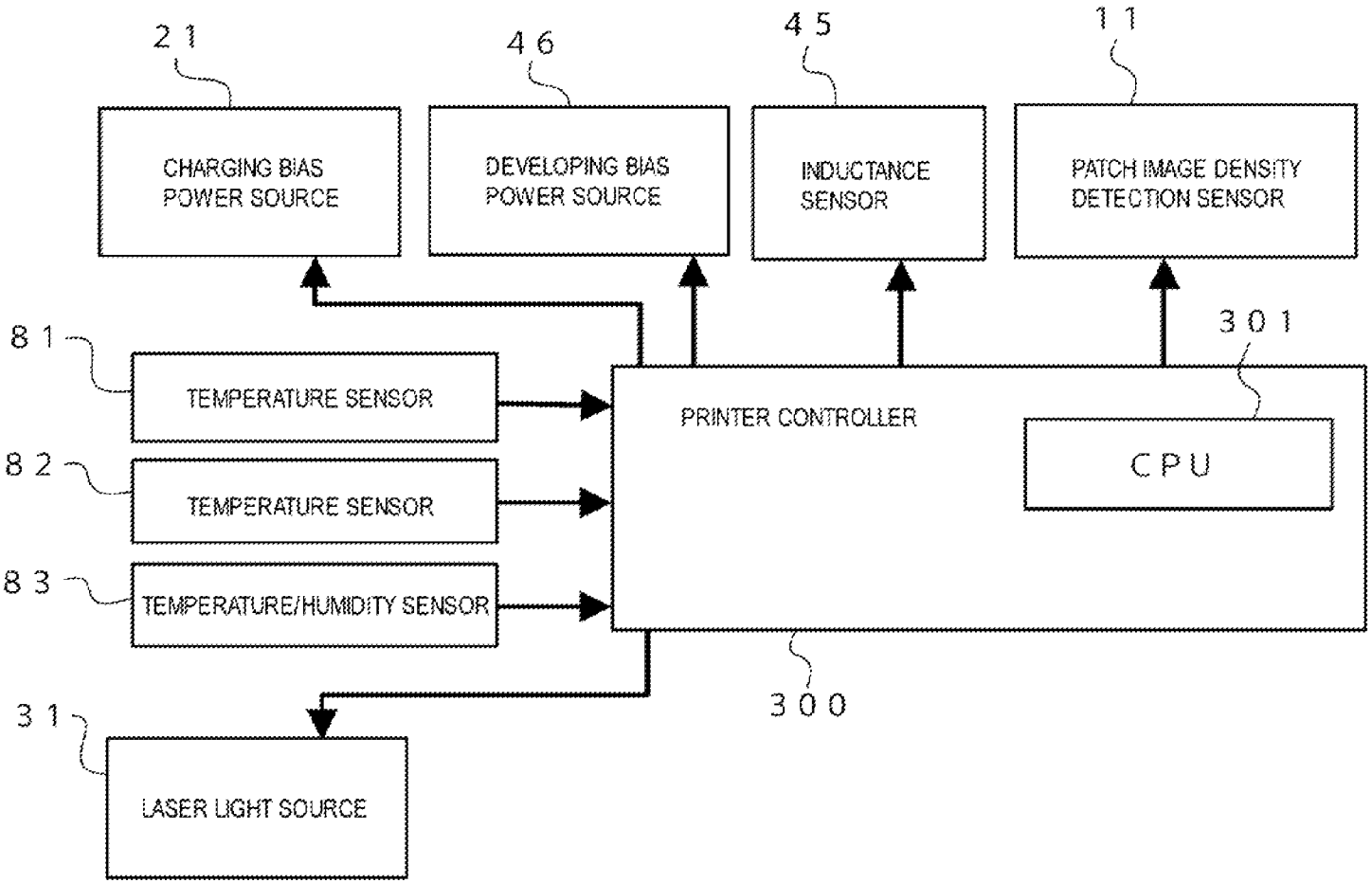
FIG. 6 is a block diagram illustrating a configuration of a control system of the image forming apparatus according to the present invention.
Figure 7A:
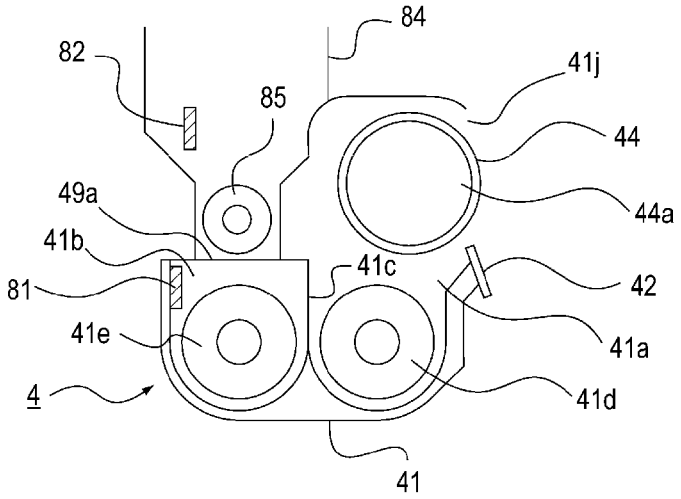
FIGS. 7A and 7B are schematic sectional views illustrating layout configurations of humidity detection portions.
Figure 7B:
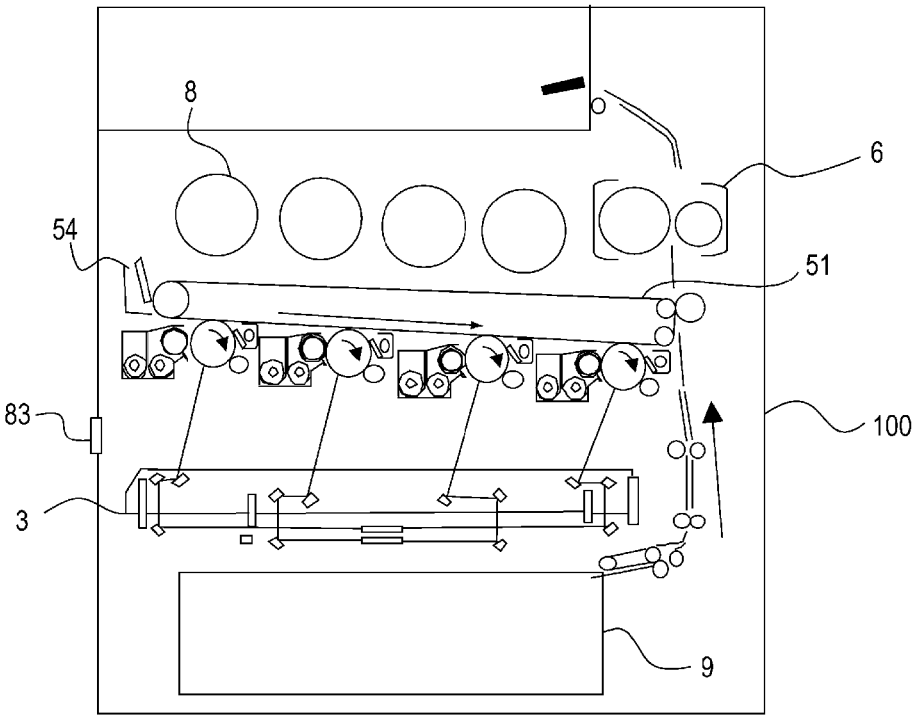

FIG. 6 illustrates a configuration of a control system of this embodiment. FIGS. 7A and 7B illustrate layout configurations of a temperature/humidity sensor and a temperature sensor serving as humidity detection portions according to this embodiment. As illustrated in FIG. 7A, a temperature sensor 81 is provided within the developing container 41. The temperature sensor 81 constitutes a first humidity detection portion, which detects information regarding humidity in an atmosphere of the developing container 41 in which the toner and the magnetic carrier are accommodated.

The temperature sensor 81 is disposed within the developing container 41 provided in the developing device 4 of each color, detects temperature T, and notifies the printer controller 300 serving as a control device of the detected temperature T. Likewise, a temperature sensor 82 constitutes a second humidity detection portion, which detects information regarding humidity in an atmosphere of the toner hopper 84 serving as a replenishing container in which replenishment toner is accommodated. The temperature sensor 82, disposed within the toner hopper 84 of each color, detects temperature t and notifies the printer controller 300 of the detected temperature t.

The temperature sensors 81 and 82 can most accurately measure temperatures of the two-component developer and the replenishment toner when the temperature sensors 81 and 82 are disposed within the developing container 41 and the toner hopper 84, respectively. However, when the layout is likely to be limited or when the developing device 4 is likely to be exchanged, the temperature sensors 81 and 82 may be installed in contact with outer walls of the developing container 41 and the toner hopper 84 or in the vicinity thereof, thereby measuring the temperatures. In addition, the toner hopper 84 may be absent according to the image forming apparatus 100. In this case, the temperature sensors 81 and 82 may be disposed on one of the toner bottle serving as the replenishing container and the toner conveyance path from the toner bottle.

As illustrated in FIG. 7B, a temperature/humidity sensor 83 is provided in a main body of the image forming apparatus 100. The temperature/humidity sensor 83 constitutes first and second humidity detection portions configured to measure an atmosphere around the apparatus from the inside of the apparatus. In this embodiment, the temperature/humidity sensor 83 of the main body of the image forming apparatus 100 and one of the temperature sensor 81 of the developing container 41 and a sensor that directly detects RH of the developing container 41 are applied to the first humidity detection portions. In addition, the temperature/humidity sensor 83 and one of the temperature sensor 82 of the toner hopper 84 and a sensor that directly detects RH of the toner hopper are applied to the second humidity detection portions.

RH(T) [%] within the developing container 41 at a temperature T [° C.] and RH(t) [%] within the toner hopper 84 at a temperature t [° C.] are calculated using the temperature/humidity sensor 83 installed in the main body of the image forming apparatus 100 in the following method. In addition, temperature/humidity sensors may each be provided as the humidity detection portion within the developing container 41 and the humidity detection portion within the toner hopper 84 instead of the temperature sensors 81 and 82. In this case, a configuration may be adapted to directly detect RH(T) [%] within the developing container 41 and RH(t) [%] within the toner hopper 84 without using the temperature/humidity sensor 83 installed in the main body of the image forming apparatus 100.

Figure 8:
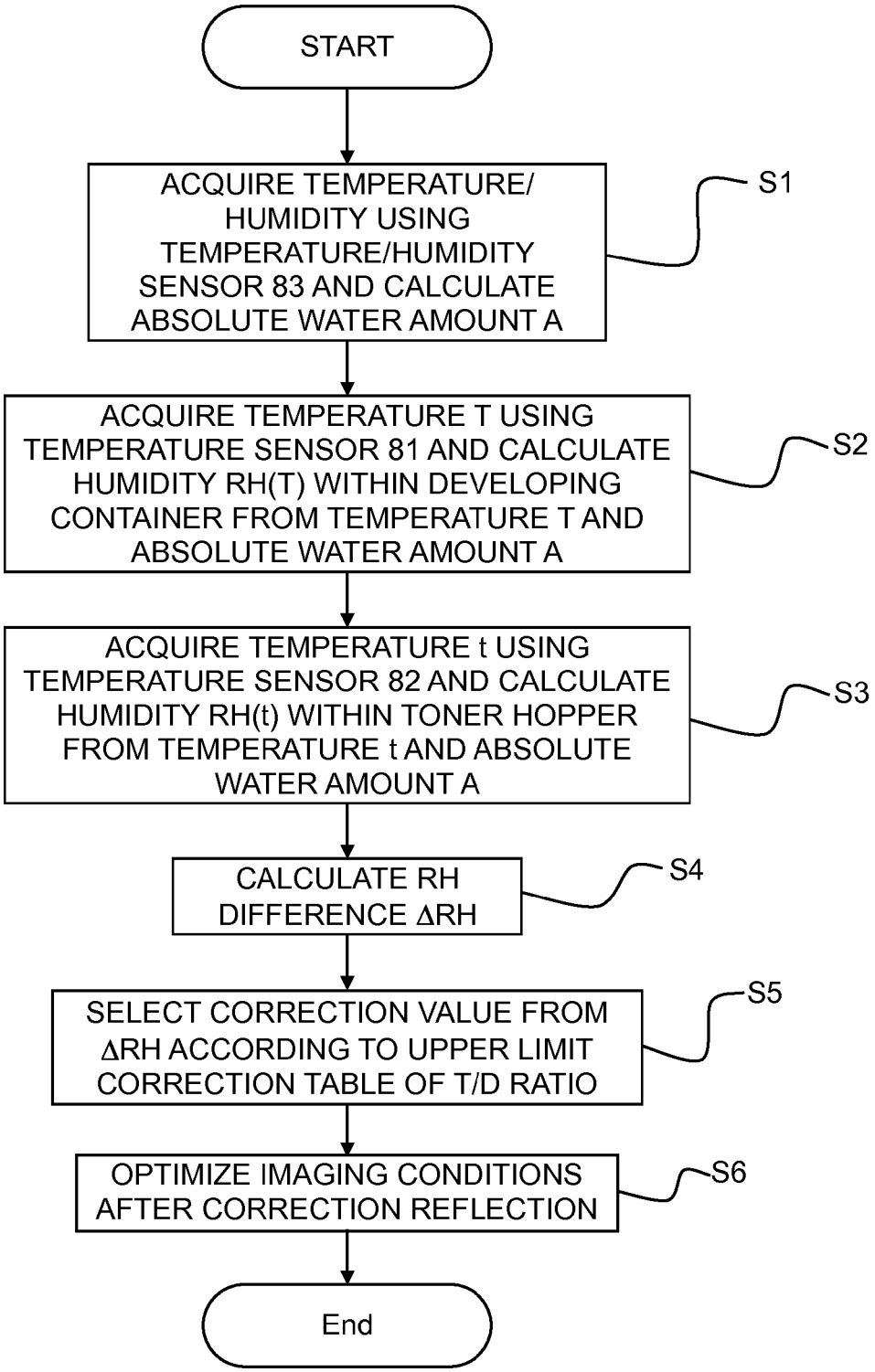
FIG. 8 is a flowchart illustrating temperature/humidity detection control of a first embodiment of the image forming apparatus according to the present invention.

FIG. 8 is a flowchart illustrating temperature/humidity detection control of this embodiment. In step S1 of FIG. 8, the printer controller 300 acquires the temperature t [° C.] and RH(t) [%] detected by the temperature/humidity sensor provided in the image forming apparatus 100, and calculates an absolute water amount A [g] (a water amount [g] in dry air of 1 (kg)). Here, an amount of water vapor in the atmosphere at RH of 100 [%] is saturated and condensation occurs. An RH value becomes greater than or equal to 0 [%] and less than or equal to 100 [%].

RH can be obtained according to a table from a temperature difference between a dry-bulb temperature and a wet-bulb temperature of a psychrometer. Although there is a humidity meter using an elastic material such as a hair hygrometer using the property of hair, an electric humidity meter for meteorological observation may be used. In addition, a dew-point meter may also be used for precise observation.

In general, there are several methods of obtaining an absolute water amount A [g] from the temperature t [° C.] and RH(t) [%]. Because the image forming apparatus 100 of this embodiment is used in an environment of approximately 1 atmosphere and a temperature of about 0 [° C.] to 60 [° C.], the water amount A [g] can be calculated by the Tetens approximation represented by the following Expression (1). Here, when a saturation water amount is E [g] and a temperature is t [° C.], the saturation water amount of E [g] at the temperature of t [° C.] can be obtained according to the following Expression (1) of the Tetens approximation.

$$E(t)=6.11\times10^{(7.5\times t/(t+237.3))} \quad (1)$$

The absolute water amount A [g] at the temperature/humidity is obtained by multiplying the saturation water amount E [g] obtained by the above-described Expression (1) by a value of RH [%]. Next, the printer controller 300 acquires a temperature measurement value T [° C.] of the temperature sensor 81, which is the temperature within the developing container 41. A central processing unit (CPU) 301 obtains the saturation water amount E [g] of the temperature T [° C.] from the temperature T [° C.] based on the above-described Expression (1). RH(T) [%] within the developing container 41 is obtained by dividing the absolute water amount A [g] by a value of the saturation water amount E [g] (step S2).

Likewise, the printer controller 300 acquires a temperature measurement value t [° C.] of the temperature sensor 82, which is the temperature within the replenishing container. The CPU 301 obtains the saturation water amount E [g] of the temperature t [° C.] from the temperature t [° C.] based on the above-described Expression (1). RH(t) [%] within the toner hopper 84 is obtained by dividing the absolute water amount A [g] by a value of the saturation water amount E [g] (step S3).

Figures 9A, 9B:
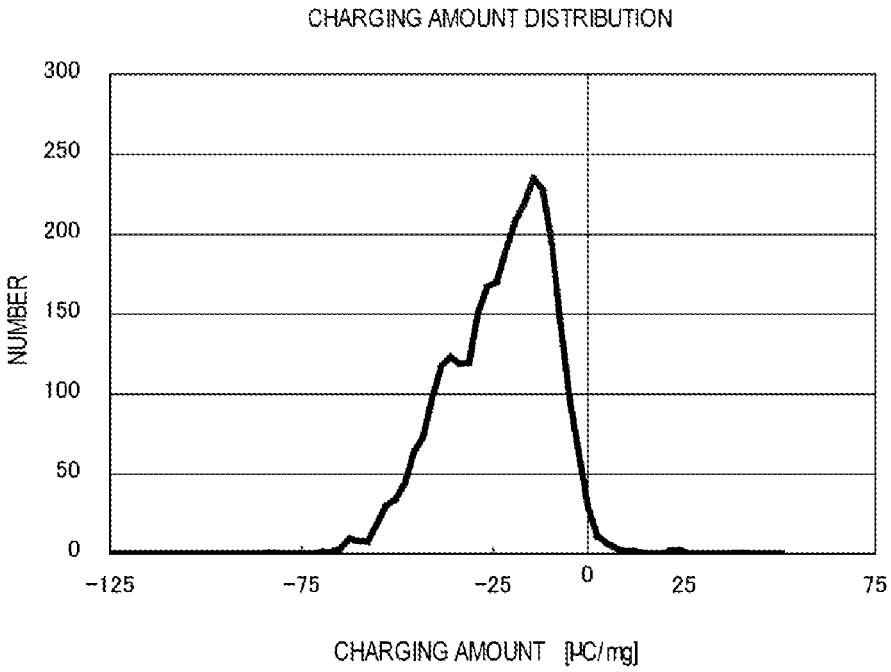
FIG. 9A is a diagram illustrating a correction control range of a T/D ratio of the first embodiment.
FIG. 9B is an example of a charging amount distribution diagram of the first embodiment.

In this embodiment, RH(T) [%] indicated by the temperature/humidity detection result within the above-described developing container 41 is compared to RH(t) [%] indicated by the above-described temperature/humidity detection result within the toner hopper 84. According to the comparison result, a control range of a T/D ratio between the toner and the magnetic carrier within the developing container 41 is set. That is, as illustrated in FIG. 9A, the upper limit of the T/D ratio is controlled to decrease when an RH difference ΔRH [%] between RH(T) [%] within the developing container 41 and RH(t) [%] within the toner hopper 84 increases.

The printer controller 300 controls a predetermined value preset for a toner density of the developing container 41 to be small when a difference between the humidity detection result of humidity in the atmosphere of the developing container 41 and the humidity detection result of humidity in the atmosphere of the toner hopper 84 serving as the replenishing container is large as compared to when the difference is small. The humidity detection result of humidity in the atmosphere of the developing container 41 and the humidity detection result of humidity in the atmosphere of the toner hopper 84 are detected by the temperature sensors 81 and 82 and the temperature/humidity sensor 83 serving as the first and second humidity detection portions. The printer controller 300 also serves as a third controller.

When the humidity of the developer within the developing container 41 is different from that of the replenishment toner, toner of which a charging amount is small is mixed with toner of which a charging amount is large. When the T/D ratio is high, a toner ratio is high and accordingly there is little opportunity for the toner to make contact with the magnetic carrier, and a charging amount distribution of the developer has a broad distribution in which a toner amount around the charging amount "0" is large as described with reference to FIG. 5.

Control of the T/D ratio will be described below in detail. In step S1 described above as illustrated in FIG. 8, the absolute water amount A [g] is calculated from the temperature/humidity detection result detected by the temperature/humidity sensor 83 provided in the main body of the image forming apparatus 100. In step S2 described above, RH(T) [%] is calculated from the temperature/humidity detection result detected by the temperature sensor 81 within the developing container 41. In step S3 described above, RH(t) [%] is calculated from the temperature/humidity detection result detected by the temperature sensor 82 within the toner hopper 84. In step S4, an RH difference ΔRH [%] between RH(T) [%] and RH(t) [%] shown in the following Expression (2) is calculated.

$$\Delta RH=|RH(T)-RH(t)| \quad (2)$$

In step S5, the upper limit of the T/D ratio is corrected using an upper limit correction table of the T/D ratio illustrated in FIG. 9A according to the RH difference ΔRH [%] obtained by the above-described Expression (2). For a value of the upper limit correction table of the T/D ratio illustrated in FIG. 9A, an RH value of each environment division is designated as a center value, and an offset value of the upper limit of the T/D ratio is calculated by linear interpolation from the detected RH value and used for control. In step S6, the upper limit of the T/D ratio is corrected.

Thereafter, if a detection value of the inductance sensor 45 becomes the upper limit of the T/D ratio, optimum values of a charging bias power source 21, a developing bias power source 46, and a laser light source 31 are controlled by the printer controller 300. Control is performed for adjustment to an appropriate image density by adjusting a developing contrast potential.

For example, variation in the temperature/humidity of the developer within the developing container 41 and the temperature/humidity within the toner hopper 84 may be maximized immediately after a toner bottle (not illustrated) within the toner hopper 84 has been exchanged.

An operation of the image forming apparatus 100 when the above-described temperature/humidity detection control illustrated in FIG. 8 is used under a high-temperature, high-humidity (for example, 30 [° C.]/80 [%]) environment will be described in detail. First, the temperature/humidity sensor 83 configured to measure the atmosphere around the apparatus from the inside of the image forming apparatus 100 detects temperature/humidity at approximately room temperature (for example, 30 [° C.]/79 [%]) environment.

In addition, because an image formation operation is continuously performed, the temperature sensor 81 within the developing container 41 detects 37 [° C.] according to rising temperature within the apparatus, and the temperature sensor 82 within the toner hopper 84 detects 35 [° C.]. At this time, the absolute water amount A=33.53 [g] within the developing container 41 is calculated by calculating the saturation water amount E=42.44 [g] at room temperature 30 [° C.] from the above-described Expression (1) and multiplying the calculated saturation water amount E by a value of RH=79 [%] at this time.

From this, RH(T) [%] within the developing container 41 is calculated to be 53 [%] from the saturation water amount E=62.76 [g] at the temperature T=37 [° C.] within the developing container 41 because the absolute water amount A=33.53 [g] is known. In general, RH is obtained according to the above-described calculation by a ratio of a water amount (absolute water amount A) present in the air to a maximum water amount (saturation water amount E) dissolved in the air at fixed temperature.

During the operation of the image forming apparatus 100, a remaining amount detection sensor (not illustrated) detects the shortage of replenishment toner within the toner hopper 84. In this case, the image forming apparatus 100 stops the operation and the toner bottle within the toner hopper 84 is exchanged. Because the toner bottle prepared in the room of the same high-temperature, high-humidity environment is sealed, its temperature is 30 [° C.], which is substantially the same as room temperature.

Because replenishment toner is full in the normal-temperature, normal-humidity environment (25 [° C.]/50 [%]), the temperature t [° C.] within the toner bottle including the same absolute water amount A [g] and within the toner hopper 84 from which a large amount of replenishment toner is supplied becomes 30 [° C.]. RH(t) [%] within the toner hopper 84 is calculated to be 37 [%]. At this time, the RH difference ΔRH [%] is Δ16 [%] (53 [%]−37 [%]=16 [%]).

In addition, under a normal-temperature, low-humidity environment (25 [° C.]/5 [%]), likewise, the temperature/humidity is detected when the toner bottle within the toner cartridge 8 communicating with the toner hopper 84 is exchanged. The temperature/humidity sensor 83 configured to measure an atmosphere around the apparatus from the inside of the image forming apparatus 100 detects the temperature/humidity of the approximately room temperature environment (23 [° C.]/5 [%]). The temperature sensor 81 of the developer within the developing container 41 detects 30 [° C.] according to rising temperature within the image forming apparatus 100.

At this time, the absolute water amount A [g] is 1.4 [g]. From this, RH(T) [%] within the developing container 41 is calculated to be 3 [%]. Because replenishment toner is full under the normal-temperature, normal-humidity environment (25 [° C.]/50 [%]), the temperature t [° C.] within the toner bottle including the same absolute water amount A [g] and within the toner hopper 84 from which a large amount of replenishment toner is supplied becomes 27 [° C.]. RH(t) [%] within the toner hopper 84 is calculated to be 44 [%]. At this time, the RH difference ΔRH [%] is Δ41 [%] (44 [%]−3 [%]=41 [%]).

After a target upper limit of the T/D ratio is changed according to an upper limit correction table of the T/D ratio illustrated in FIG. 9A, a toner replenishing operation is stopped until a target T/D ratio is reached after the change. After the target T/D ratio is reached, settings of various imaging conditions (a charging bias voltage, a developing bias voltage, and laser power adjustment) are controlled and an image density is appropriately controlled.

At this time, for the evaluation image, 10-square mm solid patch images are arranged side by side in a main scanning direction at a position of 10 mm from a tip of an A3-size recording material 10, and a halftone image is formed on one 10-mm rear-end plane in a recording material conveying direction of the patch image. The sleeve ghost can be more clearly checked in a density of an image signal value of about 40 [%] of the solid image density as the halftone image density.

In addition, a level of the sleeve ghost is determined by a density difference between a ghost generation portion of the evaluation image and a halftone portion around the ghost generation portion. The density was measured by a color reflection spectrodensitometer model 504 available from X-Rite, and the sleeve ghost level was set as illustrated in FIG. 14. In this embodiment, the sleeve ghost level was evaluated in 10 steps and level 7 or more illustrated in FIG. 14 was accepted.

According to the configuration of this embodiment, the sleeve ghost level was improved from level 5 to level 7 in the high-temperature, high-humidity environment when a sleeve ghost was generated in the high-temperature, high-humidity environment (30 [° C.]/80 [%]) and the normal-temperature, low-humidity environment (25 [° C.]/5 [%]) described above. In the normal-temperature, low-humidity environment, the sleeve ghost level was improved from level 4 to level 7. In addition, although an average value of the charging amount is slightly decreased even in the charging amount distribution of the developer during the image formation, it can be seen that low charged toner or uncharged toner is substantially absent, and a toner amount around a charging amount "0" is extremely small and has a sharp distribution as illustrated in FIG. 9B.

In addition, in the high-temperature, high-humidity environment (30 [° C.]/80 [%]) or the normal-temperature, low-humidity environment (25 [° C.]/5 [%]), the RH difference ΔRH [%] is gradually reduced when the toner bottle within the toner cartridge 8 communicating with the toner hopper 84 has been exchanged and a predetermined time has elapsed. Because the target upper limit of the T/D ratio also returned to 12 [%], a negative effect on an image was not substantially caused by decreasing the upper limit of the T/D ratio. This is because a target value of the image density is achieved without increasing a developing contrast potential by slightly decreasing the average value of the charging amount described above.

Thereby, a target upper limit of the T/D ratio is changed and set as the control range of the T/D ratio even in a state in which there is a difference between RH(T) [%] of the developer within the developing container 41 and RH(t) [%] of replenishment toner within the toner hopper 84. Thereby, a contact opportunity between the toner and the magnetic carrier could be maintained at a fixed level or more, and the level to which the sleeve ghost or a streak-like image was generated was improved by reducing an under-toner amount.

In addition, instead of the temperature sensors 81 and 82, a temperature/humidity detection sensor may be used as the humidity detection portion within the developing container 41 and the humidity detection portion within the toner hopper 84. In this case, the upper limit correction table of the T/D ratio illustrated in FIG. 9A may be determined by humidity directly detected by the temperature/humidity detection sensor.

As illustrated in FIG. 9A, the printer controller 300 controls a predetermined value preset for the toner density within the developing container to be decreased step by step according to a difference between a humidity detection result in the atmosphere of the developing container 41 and a humidity detection result in the atmosphere of the toner hopper 84 serving as the replenishing container. The humidity detection result in the atmosphere of the developing container 41 and the humidity detection result in the atmosphere of the toner hopper 84 are detected by the temperature sensors 81 and 82 and the temperature/humidity sensor 83 as the first and second humidity detection portions.

When the initial setting of the upper limit of the T/D ratio is reduced by 2 [%] and the developer is charged up without performing this embodiment, the image density is controlled according to adjustment of the developing contrast potential in a state in which the T/D ratio is lower. Thus, an image forming operation is performed in a state in which the developing contrast potential is constantly high. Thereby, in particular, a void image or low density level caused by magnetic carrier attachment, which occurs as a negative effect due to a low T/D ratio and a high developing contrast potential, is deteriorated.

In this embodiment, it is not necessary to change a lower limit of the target value of the T/D ratio. However, when the sleeve ghost is generated when the target value of the T/D ratio of the developer is near the lower limit, it is necessary to decrease the lower limit of the T/D ratio according to RH. A range in which the lower limit of the T/D ratio is decreased with respect to RH is set in correspondence with a negative effect on an image such as a screw trace.

According to the above-described configuration, a sleeve ghost or a streak-like image defect due to under toner can be reduced and an image forming apparatus without an image defect can be provided.

Second Embodiment

In this embodiment, temperature/humidity detection results detected by the temperature sensors 81 and 82 and the temperature/humidity sensor 83 serving as the first and second humidity detection portions of the first embodiment are compared. According to the comparison result, control is performed to set an amount of toner to be replenished into the developing container 41.

A charging amount of replenishment toner is improved by agitation by the screw member 41*e* even when the RH difference ΔRH [%] between RH(T) [%] of the developer within the developing container 41 and RH(t) [%] of the replenishment toner within the toner hopper is large. Thereby, the generation of the under toner can be reduced.

In a toner replenishing configuration of this embodiment, the toner hopper 84 is in communication with a replenishing port 49*a* of the developing container 41 as described with reference to FIG. 7 in the above-described first embodiment. The replenishing screw member 85 capable of conveying replenishment toner and replenishing the toner into the developing container 41 via the replenishing port 49*a* is provided at the side of the toner hopper 84. The replenishing screw member 85 is adapted to convey a predetermined amount of toner in one rotation, and toner conveyance efficiency of the replenishing screw member 85 in this embodiment is 0.1 [g/rotation]. In addition, when a solid image is printed on an A4-size recording material 10, toner consumption is about 0.3 [g]. In this case, the replenishing screw member 85 replenishes toner for three rotations.

In this embodiment, control of the toner replenishment amount is replenishment timing control for improving a charging amount of the replenishment toner described above, and control for optimizing a distribution state of replenishment toner for the developer after toner replenishment. That is, when the toner replenishment amount is controlled, there is a possibility of a negative effect in that the image density becomes low since toner replenishment is too late in some image forming jobs and the T/D ratio is low.

Figures 11A, 11B:
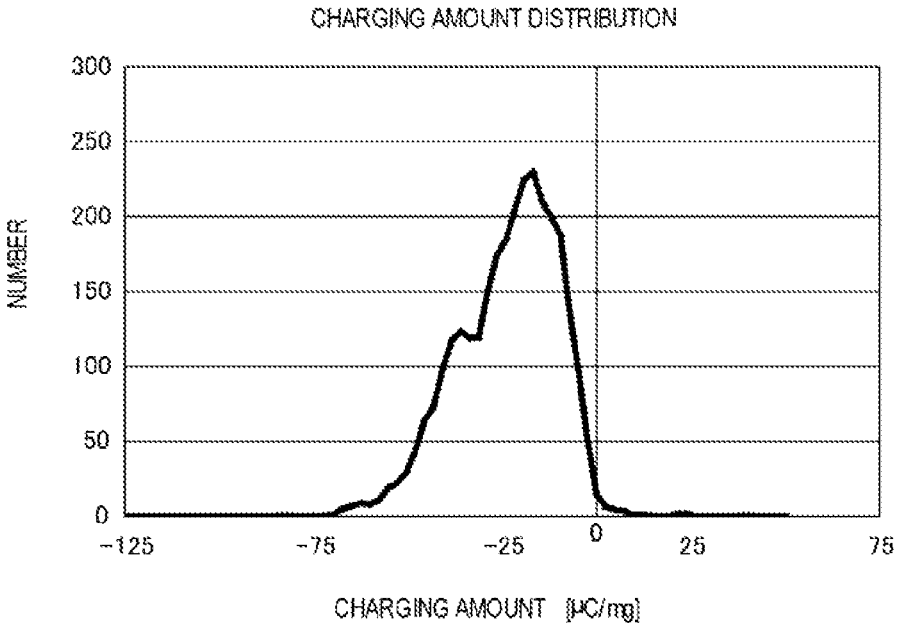
FIG. 11A is a diagram illustrating a control range of a toner replenishment amount of the second embodiment.
FIG. 11B is an example of a charging amount distribution diagram of the second embodiment.

Thus, a mode operates to secure a sufficient toner replenishment time by determining an image ratio and the number of print sheets when the image forming job is initiated, and increasing a driving time of a mutual separation interval of the recording materials according to the determination results. As illustrated in FIG. 11A, a toner replenishment amount is insufficient during imaging at a high image ratio in a region of an RH division {20≤ΔRH} in which a maximum replenishment amount of toner is in two or less rotations of the replenishing screw member 85. Thus, a toner replenishment time is secured by lengthening an imaging distance of a mutual separation interval of the recording materials 10.

That is, when the maximum replenishment amount of toner per unit time in the replenishing screw member 85 serving as a replenishing unit is small, an interval between the recording materials 10 to be conveyed during continuous image formation is changed to be increased as compared to when the maximum replenishment amount is large.

In the configuration of this embodiment, about 3 [sec] may be required until the replenishment toner is supplied from the replenishing port 49*a* onto the developing sleeve 44 by way of the agitation chamber 41*b*, and 0.5 [sec] may be required until the replenishment toner is conveyed from the replenishing port 49*a* and sufficiently spread into the developer (toner distribution time Td). Thus, it is desirable to set a toner replenishment interval of at least 0.5 [sec] in order to increase the contact opportunity between the replenishment toner and the magnetic carrier. However, because a sufficient charging amount is assignable even when the replenishment toner is appropriate at the image ratio when the RH difference ΔRH [%] is substantially absent, the sleeve ghost is not generated and the toner replenishment does not need to be limited.

In this embodiment, a time Tp required to output one sheet of an A4-size image is about 1.2 [sec]. Thus, as illustrated in FIG. 11A, in the case of an RH division {5≤ΔRH<20}, at least 1.5 [sec] is necessary for a solid image for which the necessary number of rotations of the replenishing screw member 85 becomes 3 because of an agitation time required for the above-described replenishment toner.

Thus, the mutual separation interval of the recording materials 10 is set to be greater than or equal to 0.3 [sec]. That is, when the number of rotations of the replenishing screw member 85 necessary for toner replenishment is r, the maximum number of rotations of the replenishing screw member 85 as a maximum replenishment amount of toner illustrated in FIG. 11A is set to be R. The mutual separation interval W [sec] of the recording materials 10 shown in the following Expressions (3) is controlled to be increased. At this time, when the calculated separation interval W is less than or equal to 0, control of increasing the mutual separation interval of the recording materials 10 is not performed.

$$W\,[\text{sec}]=r\times Td-Tp(R\geq r)\ \text{if}\ W>0$$

$$W=0\ \text{if}\ W>0 \tag{3}$$

As described above, the following Expression (4) is given in the case of an RH division {5≤ΔRH<20}.

$$W=3\times 0.5-1.2=0.3 \tag{4}$$

In addition, for example, if an RH division is {40≤ΔRH}, r=1 and W=−0.7. Consequently, W=0 and the setting of increasing the mutual separation interval of the recording materials 10 is not executed.

The above-described under toner is generated particularly when toner of a low charging amount is great because when the T/D ratio is high or when the replenishment amount is large, an amount of toner not attached to the magnetic carrier is large. Thus, after the developer is charged up by a low image ratio and a target value of the T/D ratio reaches the upper limit, a generated amount of under toner is largest when an image is formed at a high image ratio and a streak-like image defect easily occurs due to the sleeve ghost or the under toner.

Figure 10:
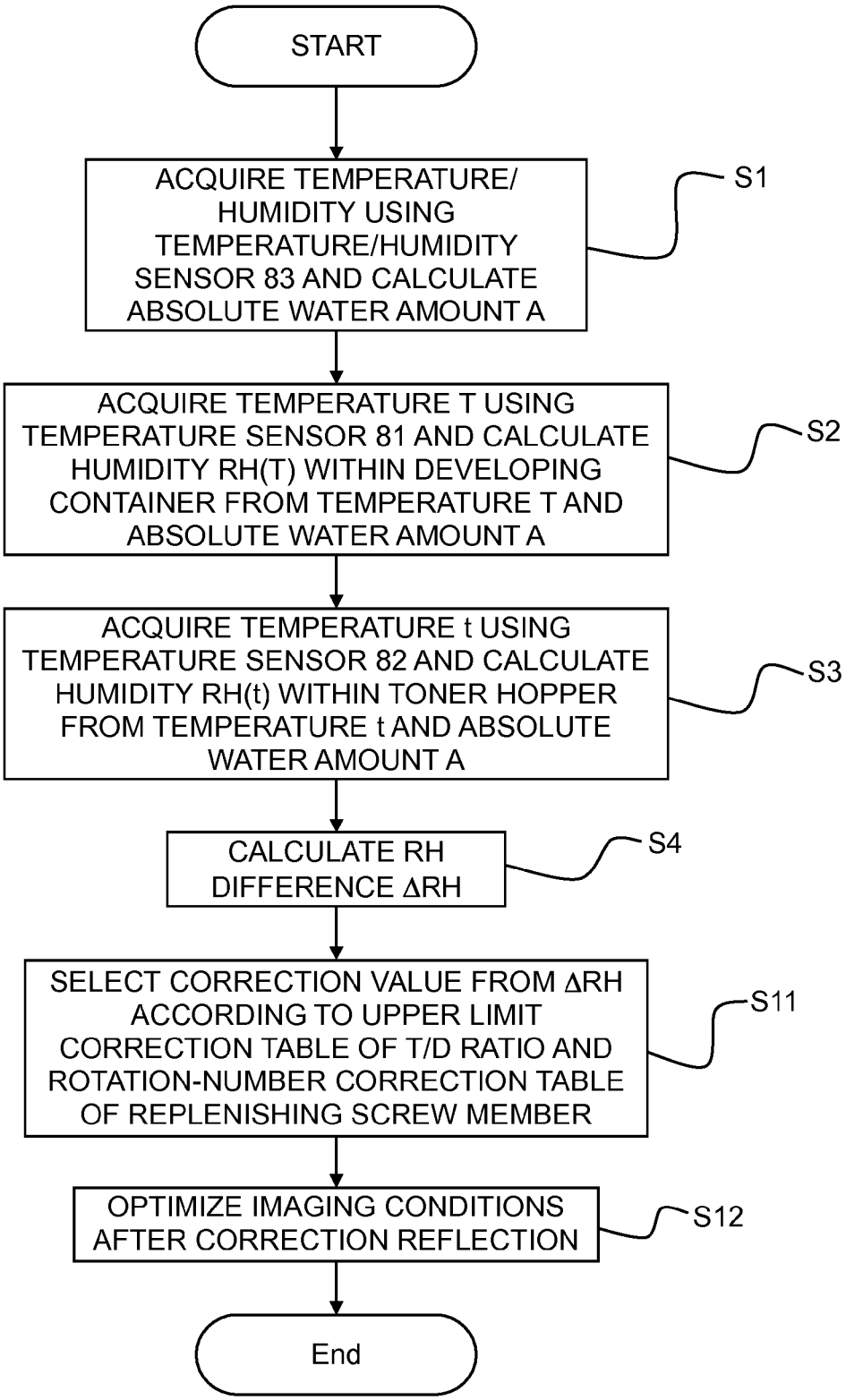
FIG. 10 is a flowchart illustrating temperature/humidity detection control of a second embodiment of the image forming apparatus according to the present invention.

At this time, in addition to the configuration of the above-described first embodiment, the streak-like image defect due to the sleeve ghost or the under toner can be reduced by performing control of setting an amount of toner to be replenished into the developing container 41. A flowchart illustrating temperature/humidity detection control of this embodiment is illustrated in FIG. 10. FIG. 11A illustrates a rotation-number correction table in which the number of rotations of the replenishing screw member 85 is controlled according to the RH difference ΔRH [%] in this embodiment.

Here, as in the above-described first embodiment, the RH difference ΔRH [%] is calculated in steps S1 to S4 of FIG. 10. That is, the RH difference ΔRH [%] between RH(T) [%] within the developing container 41 and RH(t) [%] within the toner hopper 84 is calculated using the above-described Expressions (1) and (2) from the temperature/humidity detection results detected by each of the temperature sensors 81 and 82 and the temperature/humidity sensor 83.

Next, in step S11, the upper limit of the T/D ratio is corrected as the control range of the T/D ratio between the toner and the magnetic carrier within the developing container 41 as shown in the upper limit correction table of the T/D ratio illustrated in FIG. 9A according to the RH difference ΔRH [%]. As shown in the rotation-number correction table of the replenishing screw member 85 illustrated in FIG. 11A, an image is formed in a configuration in which an amount of toner to be replenished into the developing container 41 is set by controlling the number of rotations of the replenishing screw member 85.

That is, RH(T) [%] within the developing container 41 is detected by the temperature sensor 81 and the temperature/humidity sensor 83 serving as the first humidity detection portions, and RH(t) [%] within the toner hopper 84 is detected by the temperature sensor 82 and the temperature/humidity sensor 83 serving as the second humidity detection portions. The RH difference ΔRH [%] between RH(T) [%] within the developing container 41 and RH(t) [%] within the toner hopper 84 is calculated. If the RH difference ΔRH [%] is large, an amount of toner to be replenished into the developing container 41 is decreased by decreasing the number of rotations of the replenishing screw member 85.

The printer controller 300 calculates a difference between the humidity detection result of humidity in the atmosphere of the developing container 41 and the humidity detection result of humidity in the atmosphere of the toner hopper 84 serving as a replenishing container. When the difference is large, the operation of the replenishing screw member 85 is controlled so that a maximum replenishment amount of toner per unit time of the replenishing screw member 85 serving as a replenishing unit is decreased as compared to when the difference is small. The humidity detection result of humidity in the atmosphere of the developing container 41 and the humidity detection result of humidity in the atmosphere of the toner hopper 84 are detected by the temperature sensors 81 and 82 and the temperature/humidity sensor 83 serving as the first and second humidity detection portions.

As illustrated in FIG. 11A, the printer controller 300 controls a maximum replenishment amount of toner per unit time of the replenishing screw member 85 to be decreased step by step according to a difference between the humidity detection result in the atmosphere of the developing container 41 and the humidity detection result in the atmosphere of the toner hopper 84.

In a state in which the developer is charged up during image formation as described above and the target value of the T/D ratio is the upper limit, one of a potential on the photosensitive drum 1 and laser power of the exposure device 3 is adjusted for adjustment of the developing contrast potential. After control for adjustment to an appropriate image density was performed (step S12), the level to which the sleeve ghost was generated in the presence/absence of toner replenishment control of this embodiment was checked.

In the high-temperature, high-humidity environment, the level to which the sleeve ghost was generated was level 4 when control of the toner replenishment amount of this embodiment was not performed. When control of the toner replenishment amount of this embodiment was performed, the level to which the sleeve ghost was generated could be significantly improved to level 8. At this time, when the control of the toner replenishment amount of this embodiment was performed, the charging amount distribution of toner on the developing sleeve 44 became a sharp distribution in which a toner amount was extremely small around a charging amount "0" as illustrated in FIG. 11B. When the control of the toner replenishment amount of this embodiment was not performed, the charging amount distribution became a broad distribution in which a toner amount was large around the charging amount "0."

Thereby, when the control of the toner replenishment amount of this embodiment was performed, the sleeve ghost or the streak-like image defect due to the under toner could be reduced and an image forming apparatus without an image defect could be provided.

That is, even when a humidity control situation is different between the developer within the developing container 41 and the replenishment toner within the toner hopper 84, a toner replenishment amount is limited in correspondence with the RH difference ΔRH [%] between the two. Thereby, the contact opportunity between the magnetic carrier and the replenishment toner within the developing container 41 can be constantly maintained and a charging amount of replenishment toner can be appropriately assigned. Thus, the charging amount distribution of toner within the developing container 41 can become a sharp distribution in which the toner amount around the charging amount "0" is extremely small, and the reduction of the under-toner amount and the reduction of the sleeve ghost are possible.

Third Embodiment

In this embodiment, the temperature/humidity detection results detected by the temperature sensors 81 and 82 and the temperature/humidity sensor 83 serving as the first and second humidity detection portions of the above-described embodiments are compared. According to the comparison result, the magnitude of a pullback potential difference is controlled by the printer controller 300 also serving as a bias controller. The pullback potential difference is a potential difference between a non-image portion potential of the photosensitive drum 1 serving as an electrostatic latent image bearing member and a developing potential applied to the developing sleeve 44 serving as a developer bearing member. Further, control is also performed to set the control range of the T/D ratio between the toner and the magnetic carrier within the developing container 41 according to the same comparison result, so that a better image forming apparatus can be provided with respect to the sleeve ghost.

The following two factors in which the under toner is formed on the developing sleeve 44 as a factor of the sleeve ghost are considered. First, one factor is that toner incapable of making contact with the magnetic carrier is generated. Toner is attached to the surface of the developing sleeve 44 by the pullback potential difference, which is a potential difference between the developing potential applied to the developing sleeve 44 and the non-image portion potential of the photosensitive drum 1 when free toner of a low charging amount or uncharged free toner is borne on the developing sleeve 44.

The other factor is that toner not attached to the photosensitive drum 1 is not collected on the magnetic carrier, but flies from the magnetic carrier to the electrostatic latent image due to an AC bias voltage applied as a developing bias voltage in a developing area and is attached to the surface of the developing sleeve 44. In particular, only the pullback potential difference occurs between the recording materials 10 or in a solid white background portion, and this phenomenon easily occurs in a region where no developing contrast potential is generated.

Although the pullback potential difference is set according to a size of a range in which weakly charged or reversely charged toner is not attached to the white background portion during general image formation, a center setting value in a good range of white background fog is usually used.

Toner serving as the sleeve ghost due to the under toner on the developing sleeve 44 is usually weakly charged or uncharged toner, and thus free toner or toner separated from the magnetic carrier in a developing area may be attracted to the surface of the developing sleeve 44 by the pullback potential difference of the white background portion during image formation. Thus, if the pullback potential difference is large, an amount of under toner tends to be increased when free toner is increased.

In this embodiment, as in the above-described first embodiment, the upper limit of the T/D ratio is corrected and controlled as a setting of the control range of the T/D ratio between the toner and the magnetic carrier within the developing container 41 according to the RH difference ΔRH [%]. The RH difference ΔRH [%] is a difference between RH(T) [%] of the developer within the developing container 41 and RH(t) [%] of the replenishment toner within the toner hopper 84. In addition to this, the pullback potential difference is reduced according to the same RH difference ΔRH [%], so that the generation of the under toner can be configured to be reduced and the sleeve ghost can be configured to be reduced.

RH(T) [%] within the developing container 41 is detected by the temperature sensor 81 and the temperature/humidity sensor 83 serving as the first humidity detection portions, and RH(t) [%] within the toner hopper 84 is detected by the temperature sensor and the temperature/humidity sensor 83 serving as the second humidity detection portions. The RH difference ΔRH [%] between RH(T) [%] within the developing container 41 and RH(t) [%] within the toner hopper 84 is calculated.

When the RH difference ΔRH [%] is large, the pullback potential difference, which is a potential difference between a non-image portion potential of the photosensitive drum 1 and a developing potential applied to the developing sleeve 44, is decreased as compared to when the RH difference ΔRH [%] is small. The RH difference ΔRH [%] is a difference between the humidity detection results detected by each of the first and second humidity detection portions.

Figures 13A, 13B:
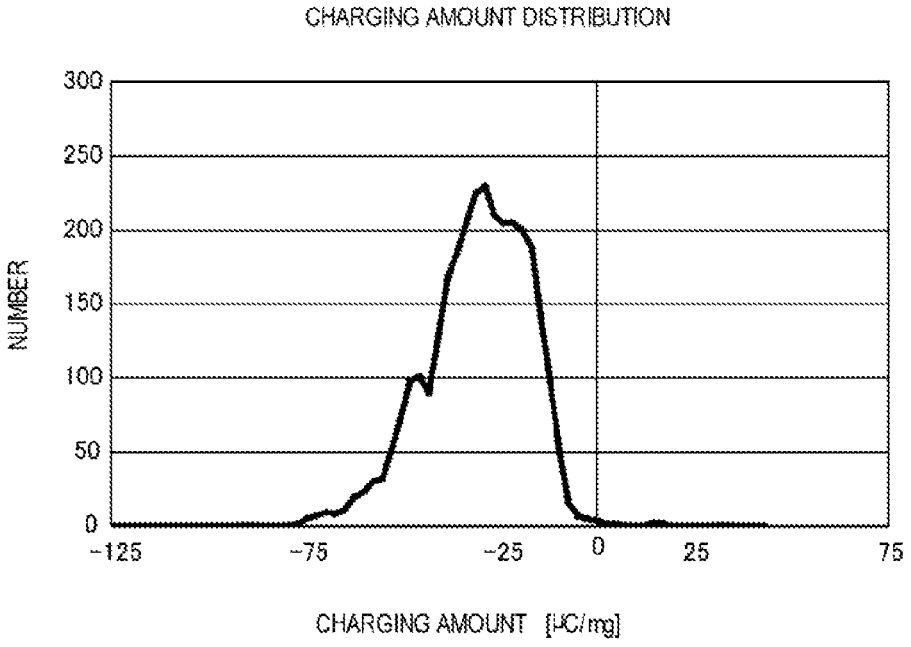
FIG. 13A is a diagram illustrating a control range of a pullback potential difference of the third embodiment.
FIG. 13B is an example of a charging amount distribution diagram of the third embodiment.

As illustrated in FIG. 13A, the printer controller 300 calculates an RH difference between RH within the developing container 41 (within the developing container) and RH within the toner hopper 84 (within the replenishing container). When the RH difference is large, the pullback potential difference, which is the potential difference between the non-image portion potential of the photosensitive drum 1 and the developing potential applied to the developing sleeve 44, is controlled to be decreased as compared to when the RH difference is small. RH within the developing container 41 is detected by the temperature sensor 81 and the temperature/humidity sensor 83 serving as the first humidity detection portions, and RH within the toner hopper 84 is detected by the temperature sensor and the temperature/humidity sensor 83 serving as the second humidity detection portions. The printer controller 300 also serves as a bias controller.

Figure 12:
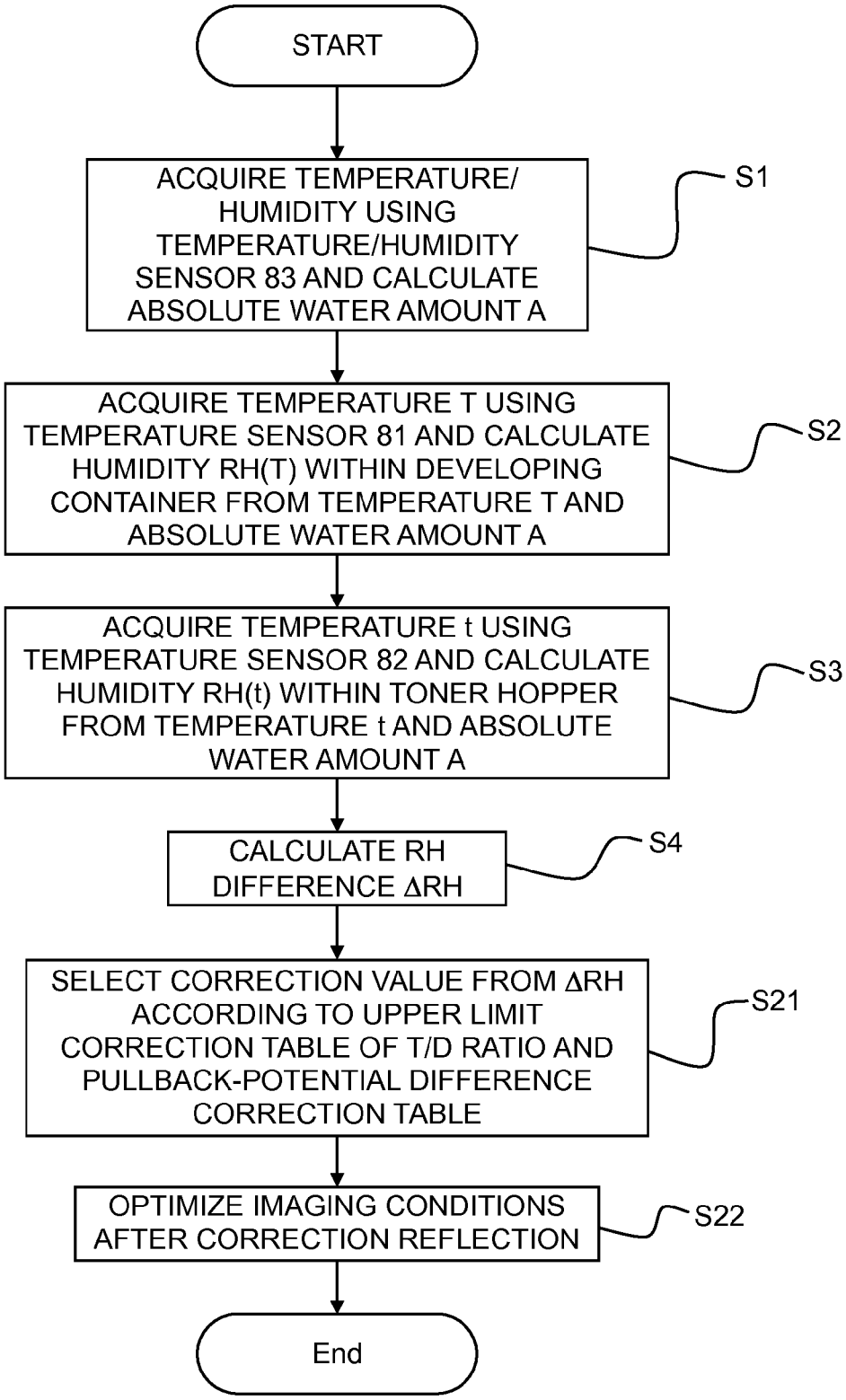
FIG. 12 is a flowchart illustrating temperature/humidity detection control of a third embodiment of the image forming apparatus according to the present invention.

A flowchart illustrating temperature/humidity detection control of this embodiment is illustrated in FIG. 12. The pullback-potential difference correction table by which the pullback-potential difference is controlled in correspondence with the RH difference ΔRH [%] in this embodiment is illustrated in FIG. 13A. In addition, upper-limit correction control of the T/D ratio between the toner and the magnetic carrier within the developing container 41 is also simultaneously performed by the above-described upper limit correction table of the T/D ratio illustrated in FIG. 9A as described in the first embodiment.

In this embodiment, the pullback potential difference for normal time is 170 [V]. In steps S1 to S4 of FIG. 12, the RH difference ΔRH [%] is calculated under the high-temperature, high-humidity environment (30 [° C.]/80 [%]). That is, the RH difference ΔRH [%] between RH(T) [%] within the developing container 41 and RH(t) [%] within the toner hopper 84 is calculated using the above-described Expressions (1) and (2) from the temperature/humidity detection results detected by each of the temperature sensors 81 and 82 and the temperature/humidity sensor 83. According to the RH difference ΔRH [%], the pullback potential difference was corrected using the pullback-potential difference correction table of FIG. 13A and the sleeve ghost was evaluated.

Under the high-temperature, high-humidity environment (30 [° C.]/80 [%]), the developing bias voltage was assumed to be −300 [V], which is a developing potential applied to the developing sleeve 44 for enabling a patch image density on the recording material 10 to be 1.45 when the patch image density was measured by the reflection spectrodensitometer X-Rite. An image was formed by designating the charging bias voltage, which is a non-image portion potential of the photosensitive drum 1 as −470 [V]. At this time, if the toner bottle within the toner cartridge 8 communicating with the toner hopper 84 is exchanged, the temperature/humidity sensor 83 provided in the main body of the image forming apparatus 100 detects the temperature/humidity outside the apparatus as (30 [° C.]/80 [%]) (step S1).

The temperature sensor 81 detects the temperature within the developing container 41 as 36 [° C.] (step S2). The temperature sensor 82 detects the temperature within the toner hopper 84 as 30 [° C.] (step S3). The RH difference ΔRH [%] from the temperature/humidity detection results detected by each of the temperature sensors 81 and 82 and the temperature/humidity sensor 83 is calculated as about Δ20 [%] (step S4). That is, the RH difference ΔRH [%] between RH(T) [%] within the developing container 41 and RH(t) [%] within the toner hopper 84 using the above-described Expressions (1) and (2) is calculated as about Δ20 [%].

In step S21, the pullback potential difference is changed from 170 [V] as an initial value to 140 [V] as a pullback potential difference shown in an RH division {20≤ΔRH<40} according to the pullback-potential difference correction table illustrated in FIG. 13A. Thus, the setting of the charging bias voltage, which is the non-image portion potential of the photosensitive drum 1 is changed from an initial value of −470 [V] to −440 [V]. At this time, as in the above-described first embodiment, 10-square mm solid patch images are arranged side by side in a main scanning direction at a position of 10 mm from a tip of an A3-size recording material 10 as evaluation images. A halftone image was formed on one 10-mm rear-end plane in a recording material conveying direction of the patch image.

In this case, the sleeve ghost level was improved from level 4 to level 9. In addition, simultaneously, for the upper limit of the T/D ratio, −1.0 [%] shown in the RH division {20≤ΔRH<40} of the upper limit correction table of the T/D ratio illustrated in FIG. 9A was set as a correction value. The setting of the initial target upper limit of the T/D ratio was changed from 12 [%] to 11 [%]. Settings of various developing conditions (a charging bias voltage, a developing bias voltage, and laser power adjustment) are controlled (step S22) and an image density is appropriately controlled. At this time, a good image can be obtained without substantially generating the white background fog on the recording material 10.

In addition, under the normal-temperature, low-humidity environment (25 [° C.]/5 [%]), the RH difference ΔRH [%] is calculated. That is, the RH difference ΔRH [%] between RH(T) [%] within the developing container 41 and RH(t) [%] within the toner hopper 84 is calculated using the above-described Expressions (1) and (2) from the temperature/humidity detection results detected by each of the temperature sensors 81 and 82 and the temperature/humidity sensor 83.

The pullback potential difference was corrected using the pullback-potential correction table of FIG. 13A according to the RH difference ΔRH [%], and the sleeve ghost was evaluated. Likewise, a patch image density on the recording material 10 reaches 1.45 when the patch image density is measured by the reflection spectrodensitometer X-Rite. For this, the developing bias voltage, which is the developing potential applied to the developing sleeve 44 was −480 [V]. An image was formed by setting the charging bias voltage, which is the surface potential of the photosensitive drum 1 to −650 [V].

At this time, when the toner bottle within the toner cartridge 8 communicating with the toner hopper 84 was exchanged, the temperature/humidity sensor 83 provided in the main body of the image forming apparatus 100 detected the temperature/humidity outside the apparatus as (25 [° C.]/5 [%]) (step S1). The temperature sensor 81 detected the temperature within the developing container 41 as 28 [° C.] (step S2). The temperature sensor 82 detected the temperature within the toner hopper 84 as 26 [° C.] (step S3).

The RH difference ΔRH [%] from the temperature/humidity detection results detected by each of the temperature sensors 81 and 82 and the temperature/humidity sensor 83 is calculated as about Δ43 [%] (step S4). That is, the RH difference ΔRH [%] between RH(T) [%] within the developing container 41 and RH(t) [%] within the toner hopper 84 using the above-described Expressions (1) and (2) is calculated as about Δ43 [%].

In step S21, the pullback potential difference is changed from an initial value of 170 [V] to 130 [V] as the pullback potential difference shown in an RH division {40≤ΔRH<60} according to the pullback-potential difference correction table illustrated in FIG. 13A. Thus, the setting of the charging bias voltage, which is the non-image portion potential of the photosensitive drum 1 was changed from an initial value of −650 [V] to −610 [V]. At this time, as in the above-described first embodiment, 10-square mm solid patch images are arranged side by side in a main scanning direction at a position of 10 mm from a tip of an A3-size recording material 10 as evaluation images. A halftone image was formed on one 10-mm rear-end plane in a recording material conveying direction of the patch image.

In this case, the sleeve ghost level was improved from level 3 to level 8. In addition, simultaneously, for the upper limit of the T/D ratio, −1.5 [%] shown in the RH division {40≤ΔRH<60} of the upper limit correction table of the T/D ratio illustrated in FIG. 9A was set as a correction value. The setting of the initial target upper limit of the T/D ratio was changed from 12 [%] to 10.5 [%].

Settings of various developing conditions (a charging bias voltage, a developing bias voltage, and laser power adjustment) are controlled, and an image density is appropriately controlled (step S22). The charging amount distribution of toner on the developing sleeve 44 could become a sharp distribution in which a toner amount is extremely small around a charging amount "0" as illustrated in FIG. 13B, and a good image could be obtained without substantially generating the white background fog on the recording material 10.

In addition, when the charging amount distribution of toner has a broad distribution in which the toner amount is large around the charging amount "0" as illustrated in FIG. 5 without performing pullback-potential difference correction control of this embodiment, reversal toner as well as weakly charged toner is generated. In this case, because reversal-toner fog is generated, a good configuration for a sleeve ghost without a negative effect can be proposed by performing the pullback-potential difference correction control of this embodiment.

According to the above, a sleeve ghost or a streak-like image defect due to under toner can be reduced and an image forming apparatus without an image defect can be provided. That is, even when a humidity control situation is different between the developer within the developing container 41 and the replenishment toner within the toner hopper 84, the upper limit of the T/D ratio of the developer within the developing container 41 is set according to the RH difference ΔRH [%]. That is, the upper limit of the T/D ratio of the developer within the developing container 41 is set according to the difference between RH(T) [%] of the developer within the developing container 41 and RH(t) [%] of replenishment toner within the toner hopper 84.

Thereby, the contact opportunity between the toner and the magnetic carrier can be high and the charging amount distribution can become a sharp distribution in which a toner amount is extremely small around a charging amount "0." Further, the pullback potential difference, which is the difference between the non-image portion potential of the photosensitive drum 1 serving as the electrostatic latent image bearing member and the developing potential applied to the developing sleeve 44 serving as a developer bearing member, is decreased. Thereby, an amount of under toner of the surface of the developing sleeve 44 can be reduced and the sleeve ghost can be reduced.

According to the above-described configuration, when a humidity control situation is different between the developer within the developing container and the replenishment toner within the replenishing container, a replenishing operation of the replenishing unit is controlled so that the toner density within the developing container is less than or equal to a predetermined value based on a detection result of a toner density sensor within the developing container. When a difference between the detection results of humidity in the atmosphere of the developing container and humidity in the atmosphere of the replenishing container detected by the first and second humidity detection portions is large, the predetermined value of the toner density within the developing container is controlled to be small as compared to when the difference is small. Thereby, the contact opportunity between the toner and the magnetic carrier can be increased and the charging amount distribution of toner can be sharply formed. An amount of under toner can be reduced and the sleeve ghost can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-049224, filed Mar. 7, 2011, which is hereby incorporated by reference herein in its entirety.

What is claimed is:

1. An image forming apparatus comprising:

a developing container in which toner and a magnetic carrier are accommodated;

a replenishing container in which replenishment toner is accommodated;

a replenishing device which replenishes a developer within the replenishing container into the developing container;

a first humidity detection portion which detects information regarding humidity in an atmosphere of the developing container;

a second humidity detection portion which detects information regarding humidity in an atmosphere of the replenishing container;

a density sensor which detects information regarding a toner density within the developing container;

a first controller which controls a replenishing operation of the replenishing device so that the toner density within the developing container is less than or equal to a predetermined value based on a detection result of the density sensor; and a second controller which controls the predetermined value to be small when a difference between humidity detection results detected by each of the first and second humidity detection portions is large as compared to when the difference is small.

2. The image forming apparatus according to claim 1, wherein the second controller controls the predetermined value to be decreased step by step according to the difference between the humidity detection results detected by each of the first and second humidity detection portions.

3. An image forming apparatus comprising:

a developing container in which toner and a magnetic carrier are accommodated;

a replenishing container in which replenishment toner is accommodated;

a replenishing device which replenishes a developer within the replenishing container into the developing container;

a first humidity detection portion which detects information regarding humidity in an atmosphere of the developing container;

a second humidity detection portion which detects information regarding humidity in an atmosphere of the replenishing container; and a controller which controls an operation of the replenishing device so that a maximum replenishment amount per unit time of the replenishing device is small when a difference between humidity detection results detected by each of the first and second humidity detection portions is large as compared to when the difference is small.

4. The image forming apparatus according to claim 3, wherein the controller controls the maximum replenishment amount to be decreased step by step according to the difference between the humidity detection results detected by each of the first and second humidity detection portions.

5. The image forming apparatus according to claim 3, wherein an interval between recording materials to be conveyed during continuous image formation is changed to be large when the maximum replenishment amount is small as compared to when the maximum replenishment amount is large.

6. An image forming apparatus comprising:

an electrostatic latent image bearing member which bears an electrostatic latent image according to image information;

a developer bearing member which is disposed to face the electrostatic latent image bearing member and supplies toner to the electrostatic latent image bearing member;

a developing container in which toner and a magnetic carrier are accommodated;

a replenishing container in which replenishment toner is accommodated;

a replenishing device which replenishes a developer within the replenishing container into the developing container;

a first humidity detection portion which detects information regarding humidity in an atmosphere of the developing container;

a second humidity detection portion which detects information regarding humidity in an atmosphere of the replenishing container; and a bias controller which controls a potential difference between a non-image portion potential of the electrostatic latent image bearing member and a developing potential applied to the developer bearing member to be small when a difference between humidity detection results detected by each of the first and second humidity detection portions is large as compared to when the difference is small.

* * * * *